US010704849B2

(12) United States Patent
Vito

(10) Patent No.: US 10,704,849 B2
(45) Date of Patent: Jul. 7, 2020

(54) QUICK LOADING AMMUNITION MAGAZINE

(71) Applicant: John Vito, North Abington Township, PA (US)

(72) Inventor: John Vito, North Abington Township, PA (US)

( * ) Notice: Subject to any disclaimer, the term of this patent is extended or adjusted under 35 U.S.C. 154(b) by 0 days.

(21) Appl. No.: 16/509,771

(22) Filed: Jul. 12, 2019

(65) Prior Publication Data

US 2020/0096271 A1 Mar. 26, 2020

Related U.S. Application Data

(60) Provisional application No. 62/697,026, filed on Jul. 12, 2018.

(51) Int. Cl.
*F41A 9/67* (2006.01)

(52) U.S. Cl.
CPC ..... *F41A 9/67* (2013.01)

(58) Field of Classification Search
CPC ..... F41A 9/67
USPC ..... 42/50
See application file for complete search history.

(56) References Cited

U.S. PATENT DOCUMENTS 1,797,951 A * 3/1931 Gaidos ..... F41A 9/67 42/50
4,027,415 A * 6/1977 Stoner ..... F41A 9/67 42/50
4,430,821 A * 2/1984 Vincent ..... F41A 9/67 42/50
4,688,344 A * 8/1987 Kim ..... F41A 9/67 42/50
5,291,679 A * 3/1994 Wollack ..... F41A 9/67 42/50
9,303,934 B1 * 4/2016 Kazsuk ..... F41A 9/83
2005/0150148 A1 * 7/2005 Herpel ..... F41A 9/67 42/50
2005/0188579 A1 * 9/2005 Gates ..... F41A 9/67 42/50
2011/0167695 A1 * 7/2011 Faifer ..... F41A 9/67 42/50
2012/0030987 A1 * 2/2012 Lee, III ..... F41A 9/67 42/87
2014/0373415 A1 * 12/2014 Faifer ..... F41A 9/65 42/49.01

(Continued)

*Primary Examiner* — Bret Hayes
(74) *Attorney, Agent, or Firm* — Riddle Patent Law, LLC; Charles L. Riddle, Esq.

(57) ABSTRACT

Ammunition magazine comprises a follower having a pull receiving passage adapted to cooperate with a pull, the passage is defined by at least one passage wall that extends from an underside surface of the follower to a head engaging surface, a pull extends through the follower at the pull receiving passage through a port in the floor plate and has a head at a head end connected to a semirigid elongated body to a tail at a tail end, the body is adapted and sized to slide within the pull receiving passage of the follower, the head is larger than the pull receiving passage and adapted to engage with head engaging surface of the follower when the pull is pulled towards the floor plate to compress the follower spring and disengage from the head engaging surface of the follower when the pull is pushed into the loaded magazine.

18 Claims, 7 Drawing Sheets

(56) References Cited

U.S. PATENT DOCUMENTS

2015/0075052 A1* 3/2015 Boyarkin ..... F41A 9/67
42/87

* cited by examiner

QUICK LOADING AMMUNITION MAGAZINE

This application claims priority to U.S. Provisional Patent Application No. 62/697,026 filed on Jul. 12, 2018 and incorporates the same by reference, the entire disclosure, as if set forth herein in its entirety.

BACKGROUND OF INVENTION a. Field of Invention

The invention relates generally to devices and methods for loading ammunition cartridges into a gun magazine.

b. Background

US 2005/0150148 describes the art relating to conventional gun magazines that universally comprise a follower and a spring that are contained within a magazine frame having an open top end (generally described as feed lips) and a base plate at the bottom end. The spring, being in contact with the base plate, biases the follower towards the open end. Ammunition is loaded into the magazine through the open end by pressing cartridges downwardly into the magazine onto the follower, against the upward bias pressure of the spring.

Manual loading of cartridges (ammunition/bullets) in ammunition magazines in general, and in rifle magazines in particular, is time consuming and painful for the fingers. Ammunition is loaded into the magazine through the open end by pressing cartridges downwardly into the magazine onto the follower, against the upward bias pressure of the spring. In addition, over time, the conventional loading method causes deformation of the lips of the magazine which, in turn, can cause problems feeding cartridges from the magazine into the chamber of the firearm. There are known several devices for aiding the loading of cartridges into magazines. Many of these devices include cover elements adapted to be mounted on a magazine for manual motion relative to the magazine to depress the cartridges in the magazine and make space for an added cartridge.

Others provide insertion of the magazine from the side of the device, without means for retaining the magazine other than the user's hand, or include complex levers with cams for rotational motion. Accordingly, there is a long felt need for a relatively simple but comfortable loading device for use with an ammunition magazine, and it is desirable to have such a device which can be built-in in the magazine.

c. Description of Related Art

The following disclosures are representative of the field pertaining to the present invention:

US 2005/0150148 describes an easy loading magazine that utilizes a pull element, such as a braided metal cord, coupled to the underside of the magazine follower and extending through an opening in the magazine base. The pull element is grasped and pulled down to compress the spring and move the follower down in the magazine frame. A keeper element holds the pull element and magazine follower near the bottom of the magazine frame while ammunition is loaded into the magazine. The drawback with this type of device is that the pull element is left to dangle below the magazine during operation of the firearm.

US 2014/0373415 describes an ammunition magazine including a housing having a base, a follower spring-biased in the housing against the base, a chain coupled to the follower for pulling the follower towards the base to permit loading of cartridges into the magazine, and a mechanism for collecting a loose portion of the chain mounted on the follower, the chain being coupled to the mechanism for collecting a loose portion of the chain, the mechanism being configured to collect a loose portion of the chain after the follower has been pulled towards the base. The drawback with this device concerns a pulley and clock spring mechanism that involves many moving parts that can result in contamination and jamming.

It is an object of the present invention to provide an ammunition magazine having an easy loading function that causes the follower to travel away from the feed lips and lock so that ammunition can be loaded into the magazine without being required to press each cartridge against the bias of the spring pressing against the follower. It is further an object of the present invention to achieve this result without having a pull element dangling outside the magazine. It is further an object of the invention to achieve retraction of the pull element without a complex components that can be contaminated or fail.

SUMMARY OF INVENTION

A present invention ammunition magazine 11 is disclosed. The magazine comprises a casing having a mostly rectangular cross-section, with fore and aft sides, two longer lateral sides, and first and second ends. A floor plate closes the casing at the second end. A spring and follower are located within the casing. The spring is located between the floor plate and the follower for biasing the follower towards the first end where the magazine is loaded and unloaded with ammunition.

The follower comprises a follower platform that extends generally horizontally from a fore end to an aft end. A fore tine is located at the fore end of the follower platform and extends generally perpendicularly from the follower platform fore end to a fore tine end. An aft tine is located at the aft end of the follower platform opposing the fore tine and also extends generally perpendicularly from the follower platform aft end to an aft tine end.

The follower has a pull receiving passage adapted to cooperate with a pull. The passage is defined by at least one passage wall that extends from an underside surface of the aft tine to a head engaging surface. The head engaging surface is defined as the outside surface of the aft tine or the aft end of the follower platform located at or near to the intersection of the aft end of the follower platform and the aft tine.

The pull extends through the follower at the pull receiving passage through a port in the floor plate. The pull has a head at a head end connected to a semirigid elongated body to a tail at a tail end. The body is adapted and sized to slide within the pull receiving passage of the follower. The head is larger than the pull receiving passage and adapted to engage with head engaging surface of the follower when the pull is pulled towards the floor plate to compress the follower spring.

The magazine has a releasable lock located at the floor plate. The lock is adapted to cooperate with the pull such that, normally, the lock only allows the pull to travel incrementally in a direction that causes the follower to compress the follower spring. When a release is engaged, the pull may travel in a direction that allows the follower spring to push the follower away from the floor plate.

In an embodiment of the present invention, the head engaging surface of the follower is a recess that is milled into or formed as part of the follower. The recess is adapted to contain the head of the pull such that the head does not protrude from the follower when a force is exerted on the pull in a direction that compresses the follower spring.

A present invention method of loading an ammunition magazine is disclosed. The method includes the following steps. The ammunition magazine described herein is provided. The follower spring is compressed by drawing the pull through the releasable lock. This causes the head of the pull to engage the head engaging surface and the follower to travel towards the floor plate. As an increment of the body of the pull travels through the lock, the lock cooperates with the body of the pull to prevent the pull from traveling upward towards the first open end. Ammunition is inserted into the first open end. After ammunition is inserted, the lock is released, which causes the follower spring to bias the follower towards the first open end. After the release is engaged, the pull is pushed towards the first end into the magazine casing. The head of the pull decouples from the head engaging surface of the follower, and the body of the pull slides through the pull receiving passage of the follower in a direction towards the first open end.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE EMBODIMENTS

Figure 1:
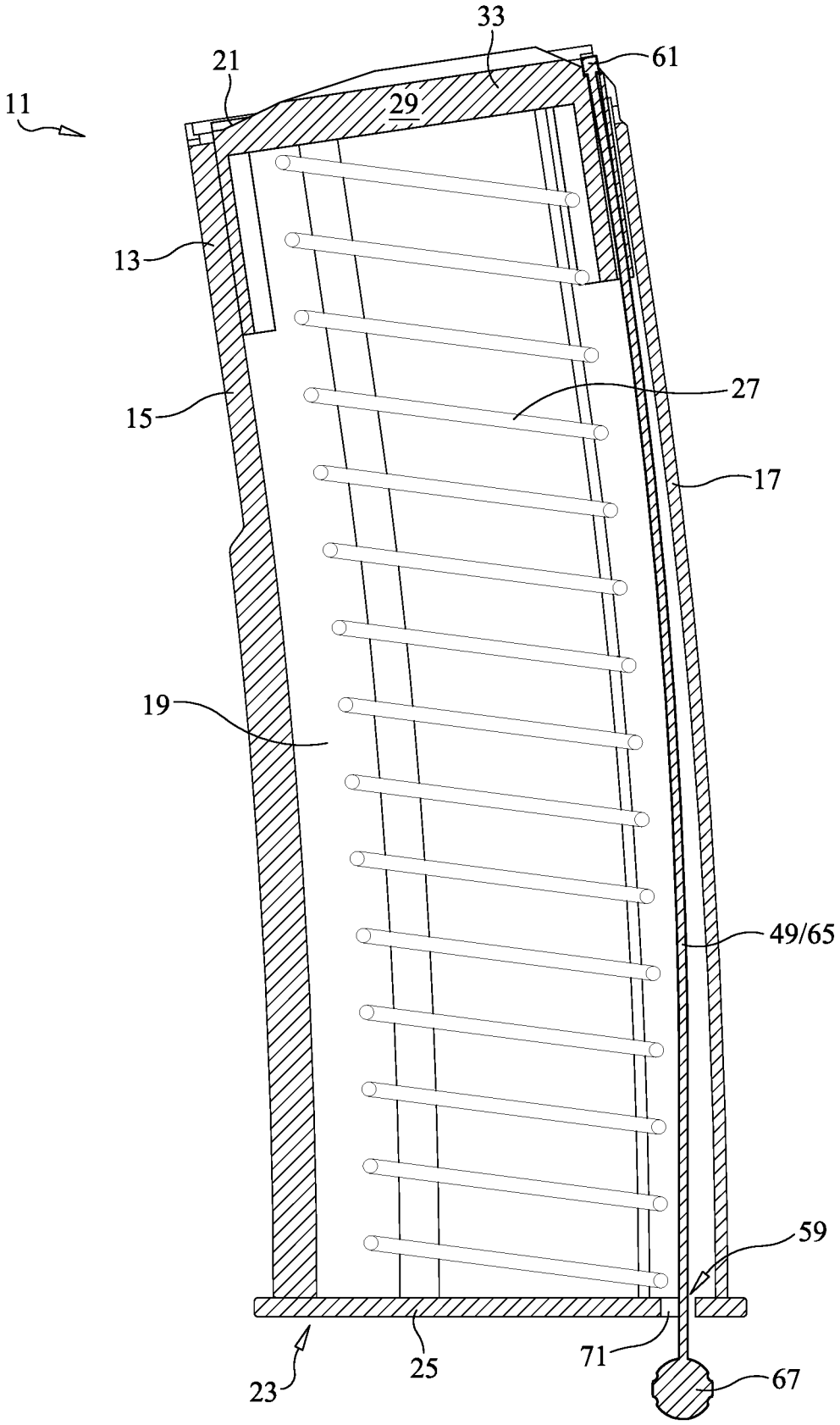
FIG. 1 shows a cutaway section view of the present invention magazine in an unloaded state with the spring decompressed.
Figure 2:
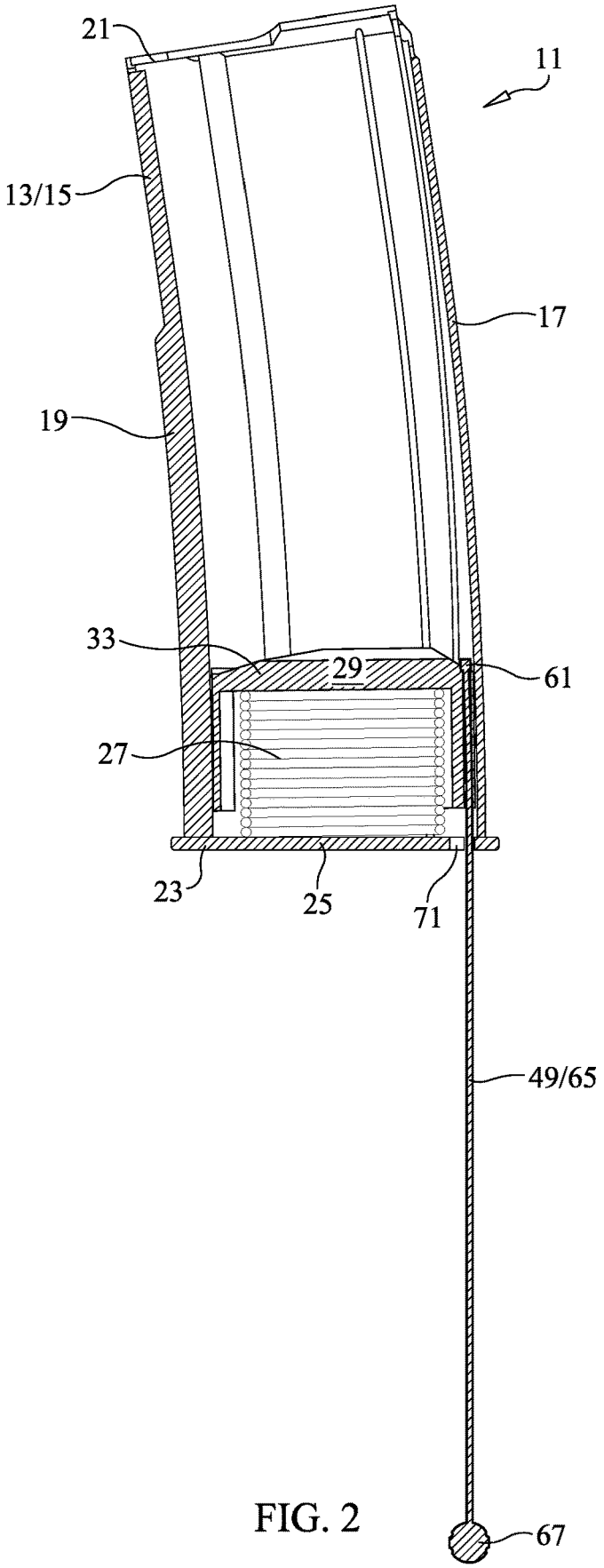
FIG. 2 shows a cutaway section view of the present invention magazine in an unloaded state with the spring compressed by the pull and follower.
Figure 3:
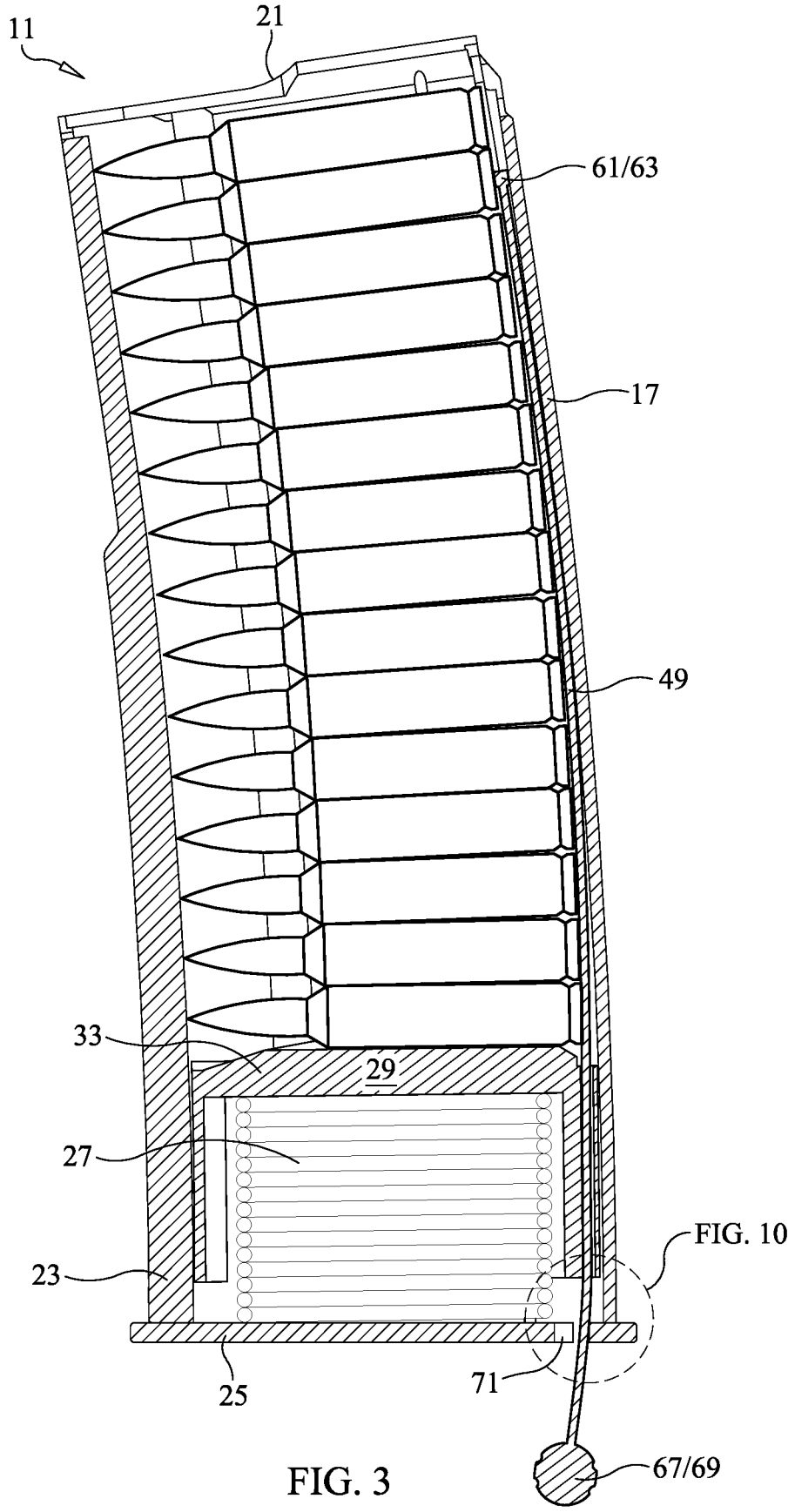
FIG. 3 shows a cutaway section view of the present invention magazine in an loaded state with the pull decoupled from the follower and stored within the magazine.
Figure 4:
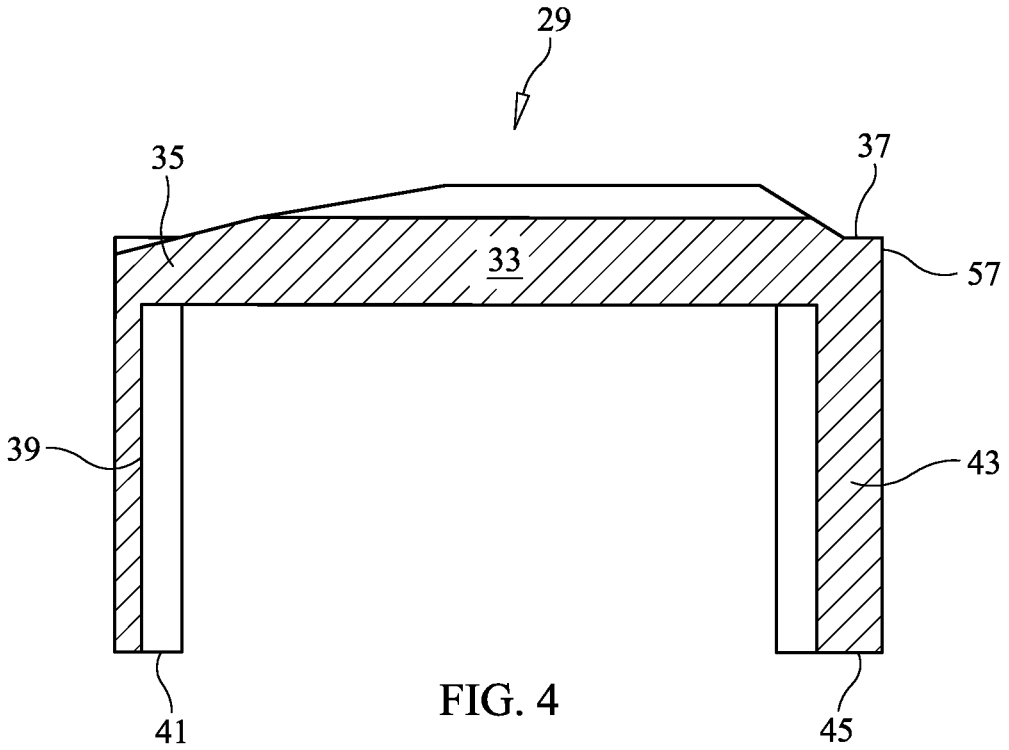
FIG. 4 shows a cutaway section view of a prior art follower.

The invention relates generally to an easy loading ammunition magazine and methods for use of the same. Turning to the figures generally, and particularly FIGS. 1-3, there is shown an ammunition magazine 11. The magazine comprises a casing 13 having a mostly rectangular cross-section, with fore 15 and aft 17 sides, two longer lateral sides 19, and first 21 and second ends 23. A floor plate 25 closes the casing at the second end 23. A spring 27 and follower 29 are located within the casing 13. The spring 27 is located between the floor plate 25 and the follower 29 for biasing the follower 29 towards the first end 21 where the magazine 11 is loaded and unloaded with ammunition 31.

With particular reference to FIGS. 4-9, the follower 29 comprises a follower platform 33 that extends generally horizontally from a fore end 35 to an aft end 37. A fore tine 39 is located at the fore end 35 of the follower platform 33 and extends generally perpendicularly from the follower platform 33 fore end 35 to a fore tine end 41. An aft tine 43 is located at the aft end 37 of the follower platform 33 opposing the fore tine 39 and also extends generally perpendicularly from the follower platform 33 aft end 37 to an aft tine end 45.

The follower 29 has a pull receiving passage 47 that is adapted to cooperate with a pull 49. The passage 47 is defined by at least one passage wall 51 that extends from an underside surface 53 to a head engaging surface 55. In an embodiment of the present invention, the head engaging surface 55 is defined as an outside surface 57 of the aft tine 43 or the aft end 37 of the follower platform 33 located at or near to the intersection of the aft end 37 of the follower platform 33 and the aft tine 43. This configuration allows the body 65 and head 61 of the pull 49 to interface with the follower 29 along the aft tine end 45/aft side 17 of the magazine 11.

In an alternate embodiment, the head engaging surface 55 is defined as an outer surface 56 of the follower 29 located along the follower platform 33 at a location between the fore end 35 and the aft end 37. This configuration allows the head 61 to interface with the follower 29 along a lateral side 19 of the casing 13 of the magazine 11.

In an alternate embodiment, the head engaging surface 55 is defined as an exterior surface 58 of the fore tine 39 located at or near to an intersection of the fore end 35 of the follower platform and the fore tine 39.

In a preferred embodiment of the present invention, the head engaging surface 55 of the follower 29 further forms a recess 75 into the structure of the follower 29 adapted to contain the head 61 of the pull 49 such that the head 61 does not protrude from the follower 29 when a force is exerted on the pull 49 in a direction that compresses the spring 27. The recess 55 can be milled into the structure of the follower 29 or formed as a unitary structure.

In an embodiment, the underside surface 53 of the follower 29, where the pull receiving passage 47 begins, is an inside surface 53 of the aft tine 43. This configuration allows the body 65 of the pull 49 to slidably interface with the follower 29 slightly diagonally through the aft tine 43 outwardly to the head engaging surface 55, when the head engaging surface 55 is located outside surface of the aft tine 57 or the aft end 37 of the follower platform 33 located at or near to the intersection of the aft end 37 of the follower platform 33 and the aft tine 43.

Figure 5:
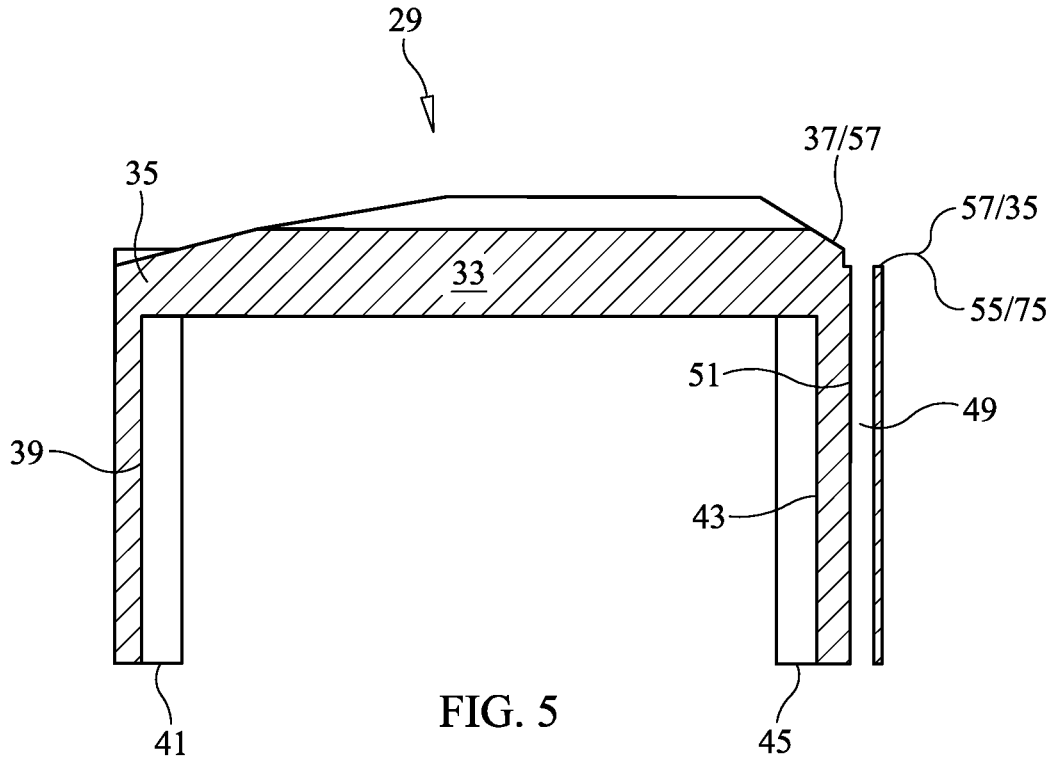
FIG. 5 shows a cutaway section view the follower according to an embodiment of the present invention.
Figure 6:
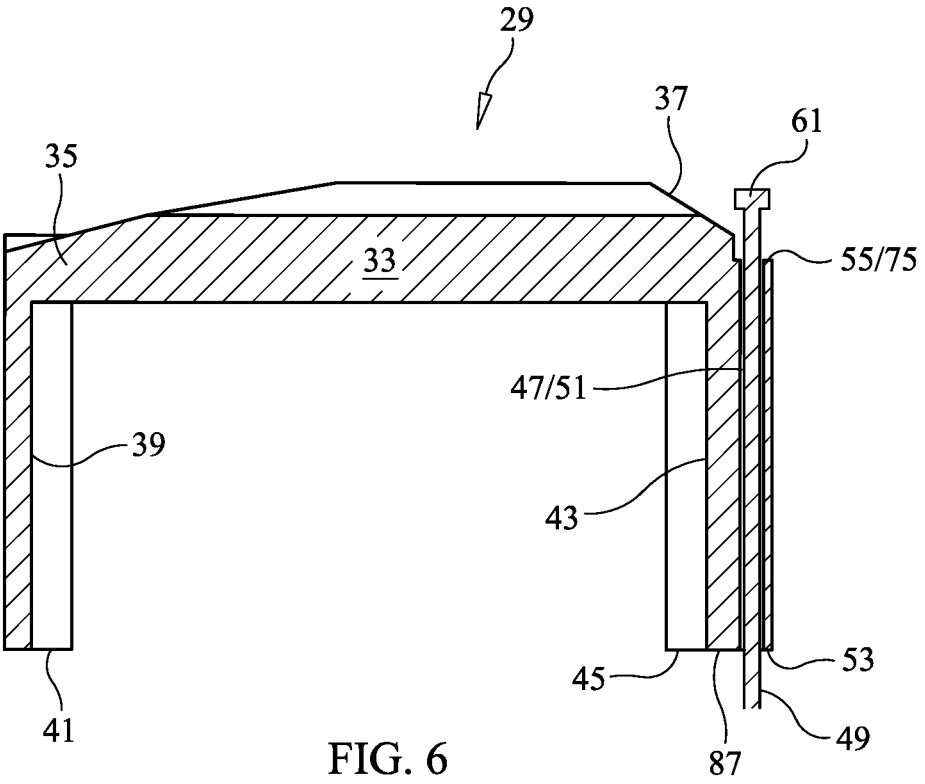
FIG. 6 shows a cutaway section view the follower according to an embodiment of the present invention with a pull partially inserted.
Figure 7:
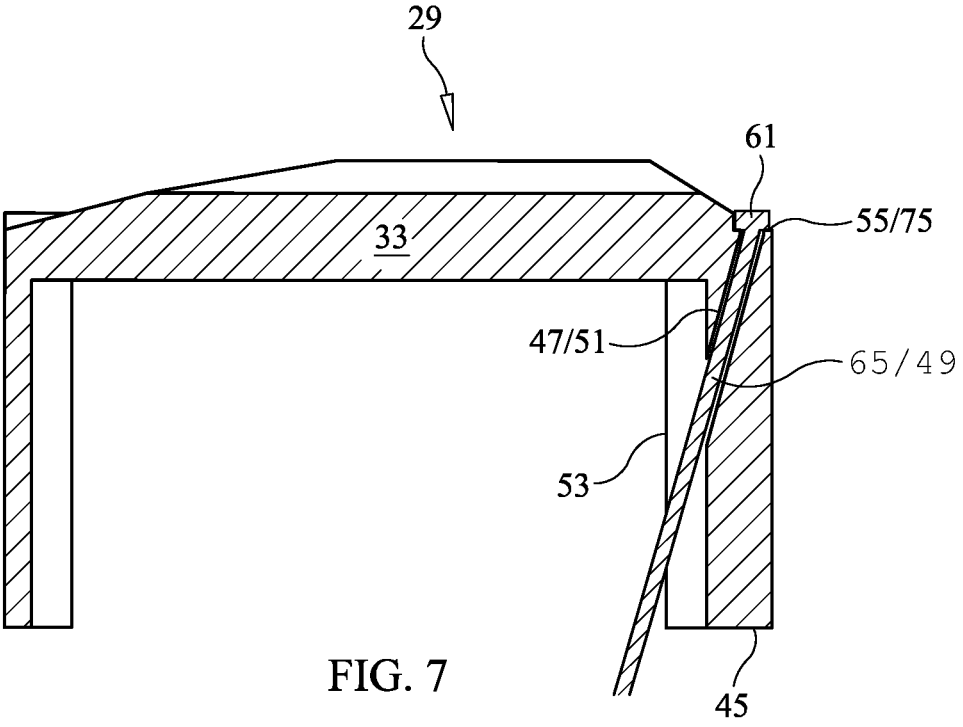
FIG. 7 shows a cutaway section view the follower according to an embodiment of the present invention with a pull partially inserted.
Figure 8:
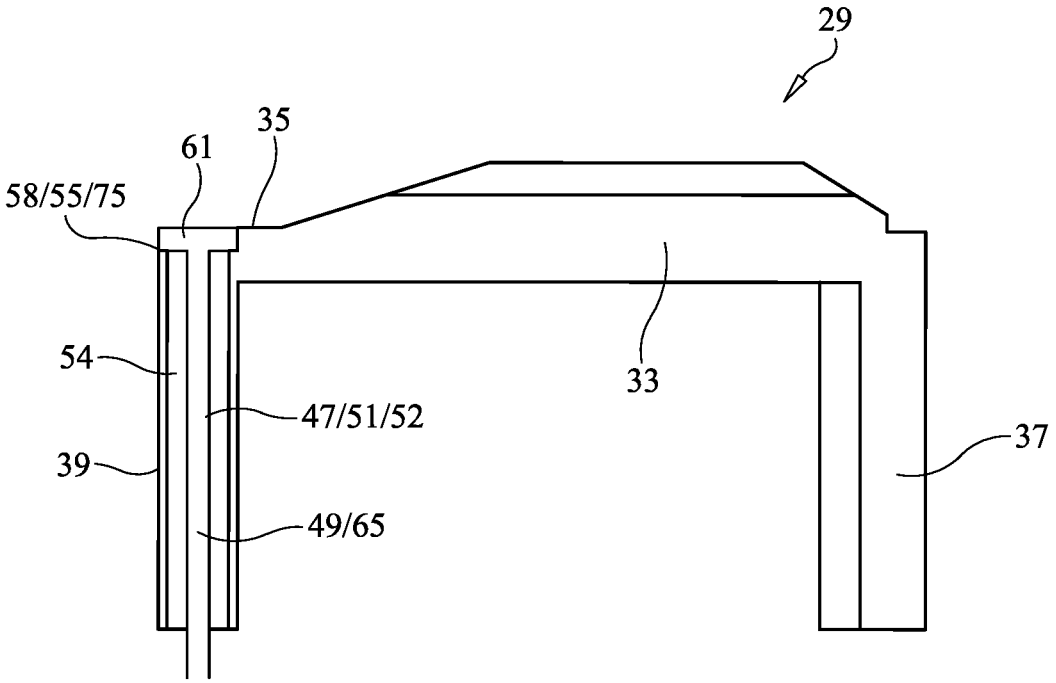
FIG. 8 shows a side view the follower according to an embodiment of the present invention with a pull inserted.
Figure 9:
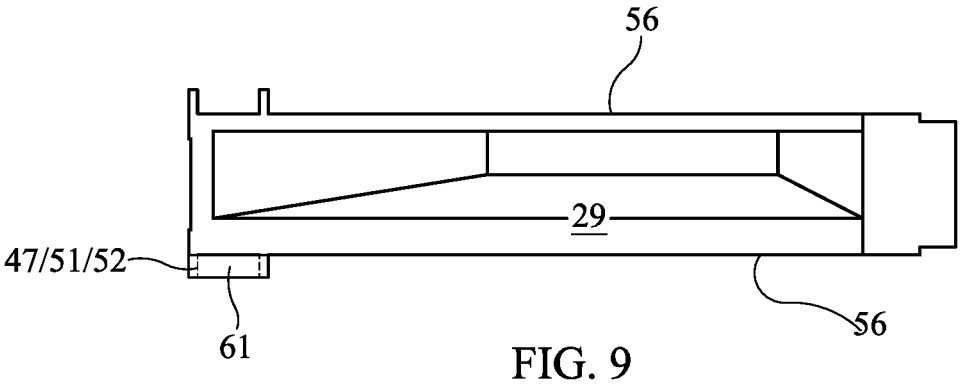
FIG. 9 shows a top view the follower according to an embodiment of the present invention with a pull inserted.

Referring to FIGS. 5-6, in an embodiment, the underside surface 53 of the follower 29, where the pull receiving passage 47 begins, is at the tip 87 of the aft tine 43. This configuration allows the body 65 of the pull 49 to slidably interface with the follower 29 vertically through the aft tine to the head engaging surface 55, when the head engaging surface 55 is located at the outside surface of the aft tine 57 or the aft end 37 of the follower platform 33 located at or near to the intersection of the aft end 37 of the follower platform 33 and the aft tine 43.

Referring to FIGS. 5-6 and 8-9, in an embodiment of the present invention, the passage 47/passage wall 51 takes the form of a groove or channel 52, or c shaped channel, located on an outside surface 57 of the aft tine 43 or an external surface 54 of the fore tine 39.

In an embodiment of the present invention, the head engaging surface 55 of the follower 29 is a recess 75 that is milled into or formed as part of the follower 29. The recess 75 is adapted to contain the head 61 of the pull 49 such that the head 61 does not protrude from the follower 29 when a force is exerted on the pull 49 in a direction that compresses the follower spring 27.

The pull 49 extends through the follower 29 at the pull receiving passage 47 to a port 59 in the floor plate 25. The pull 49 has a head 61 at a head end 63 connected to a semirigid elongated body 65 to a tail 67 at a tail end 69. The body 65 is adapted and sized to slide within the pull receiving passage 47 of the follower 29. The head 61 is larger than the pull receiving passage 47 and adapted to engage with head engaging surface 55 of the follower 29 when the pull 49 is pulled towards the floor plate 25 to compress the follower spring 27.

The magazine 11 has a releasable lock 71 located at the floor plate 25. The lock 71 is adapted to cooperate with the pull 49 such that, normally, the lock 71 only allows the pull 49 to travel incrementally in a direction that causes the follower 29 to compress the follower spring 27. When a release 73 is engaged, the pull 49 may travel in a direction that allows the follower spring 27 to push the follower 29 away from the floor plate 25.

In a preferred embodiment the body 65 of the pull 49 is an elongated strap 77 having row of teeth 79 disposed on at least one longitudinal surface 81 of the strap 77 and arranged transversely with respect thereto. The body 65 may also being a ladder structure or a beaded structure, or any other structure or arrangement capable of engaging with the lock 71 to enable allows the pull 49 to travel incrementally in a direction that causes the follower 29 to compress the follower spring 27, but, when a release 73 is engaged, the pull 49 may travel in a direction that allows the follower spring 27 to push the follower 29 away from the floor plate 25.

Figure 10:
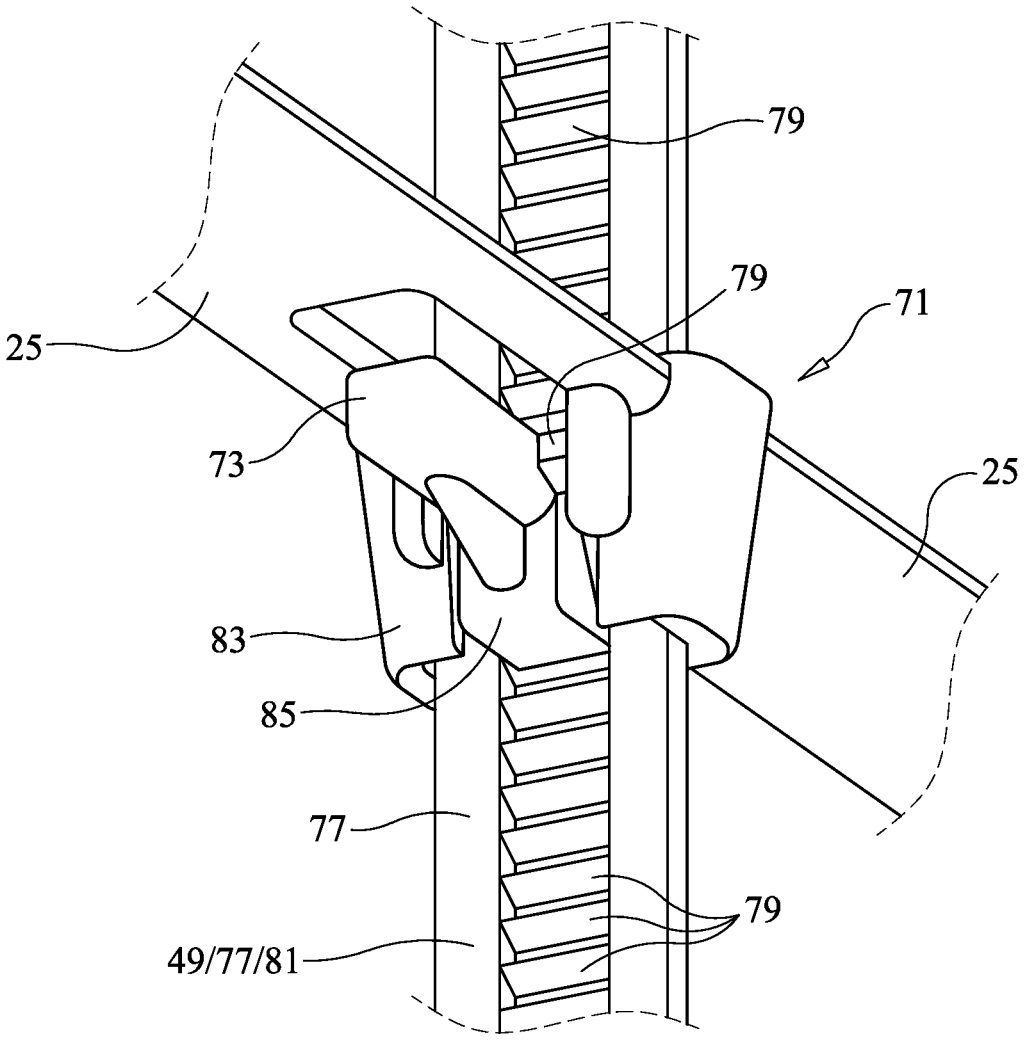
FIG. 10 shows a cutaway bottom partial perspective view of a floor plate and releasable lock according to an embodiment of the present invention.

Referring to FIG. 10, the lock 71 including a locking frame 83 for containing the strap 77/body 65/pull 49, and a pawl 85 for engaging the teeth 79, ladder, or beaded structure of the strap 77/body 65/pull 49. The pawl 85 connected to an operable release 73, such as a button or lever. The release 73 is operable by a user and acts to release the pawl 85 from engaging the teeth 79, ladder, or beaded structure of the strap 77/body 65/pull 49, thereby allowing the follower 29 to travel towards the first end 21 under the bias of the spring 27. These ratchet cable tie systems are similar to the type described in U.S. Pat. No. 3,991,444 to Bailey, U.S. Pat. No. 3,908,233 to Caveney, U.S. Pat. No. 7,866,005 to Vermeer and U.S. Pat. No. 6,185,791 to Khokhar.

A present invention method of loading an ammunition magazine 11 is disclosed. The method includes the following steps. The ammunition magazine 11 described herein is provided. The follower spring 27 is compressed by drawing the pull 49 through the releasable lock 71. This causes the head 61 of the pull to engage the head engaging surface 55 and the follower 29 to travel towards the floor plate 25. As an increment of the body 65 of the pull 49 travels through the lock 71, the lock 71 cooperates with the body 65 of the pull 49 to prevent the pull 49 from traveling upward towards the first end 21. Ammunition 31 is inserted into the first end 21. After ammunition 31 is inserted, the lock 71 is released, which causes the follower spring 27 to bias the follower 29 towards the first end 21. After the release 73 is engaged, the pull 49 body 65 is pushed towards the first end 21 into the magazine 11 casing 13. The head 61 of the pull 49 decouples from the head engaging surface 55 of the follower 29, and the body 65 of the pull slides through the pull receiving passage 47 of the follower in a direction towards the first end 21.

What is claimed is:

1. An ammunition magazine comprising:

a. a casing having a mostly rectangular cross-section with fore and aft sides and two longer lateral sides and first and second open ends, b. a floor plate capable of interfacing the magazine at the second end;

c. a follower residing within the casing, said follower further comprising:

i. a follower platform extending generally horizontally from a fore end to an aft end, and ii. a fore tine located at the fore end of the follower platform and extending generally perpendicularly from the follower platform fore end to a fore tine end, and/or an aft tine located at the aft end of the follower platform opposing the fore tine and extending generally perpendicularly from the follower platform aft end to an aft tine end; and iii. a pull receiving passage defined by at least one passage wall extending from an underside surface to a head engaging surface;

d. a follower spring residing between the follower and floor plate; and e. a pull extending through the follower at the pull receiving passage, through a port in the floor plate, the pull defined by a head at a head end connected by a semirigid elongated body to a tail at a tail end, the body adapted and sized to slide within the pull receiving passage of the follower, the head being larger than the pull receiving passage and disposed to engage with head engaging surface of the follower when the pull is pulled towards the floor plate to compress the follower spring.

2. The ammunition magazine of claim 1, the head engaging surface defined as an outside surface of the aft tine or the aft end of the follower platform located at or near to the intersection of the aft end of the follower platform and the aft tine.

3. The ammunition magazine of claim 1, the head engaging surface defined as an outer surface of the follower located along the follower platform at a location between the fore end and the aft end.

4. The ammunition magazine of claim 1, the head engaging surface defined an exterior surface of the fore tine located at or near to the intersection of the fore end of the follower platform and the fore tine.

5. The ammunition magazine of claim 1, the head engaging surface of the follower further being a recess adapted to contain the head of the pull such that the head does not protrude from the follower when a force is exerted on the pull in a direction that compresses the follower spring.

6. The ammunition magazine of claim 1, the underside surface being an inside surface of the aft tine.

7. The ammunition magazine of claim 2, the underside surface being an inside surface of the aft tine.

8. The ammunition magazine of claim 1, the underside surface being a tip of the aft tine.

9. The ammunition magazine of claim 2, the underside surface being a tip of the aft tine.

10. The ammunition magazine of claim 1, the passage wall being a groove or channel located on an outside surface of the aft tine.

11. The ammunition magazine of claim 1, the passage wall being a groove or channel located on an exterior surface of the fore tine.

12. The ammunition magazine of claim 1, the pull receiving passage being a channel fixed to the fore tine, or the aft tine, or the follower platform.

13. The ammunition magazine of claim 1, further including a releasable lock located at the floor plate and adapted to cooperate with the pull such that, normally, the lock only allows the pull to travel incrementally in a direction that causes the follower to compress the follower spring, but, when a release is engaged, the pull may travel in a direction that allows the follower spring to push the follower away from the floor plate.

14. The ammunition magazine of claim 13 further including:

a. the body of the pull being a ladder structure, a beaded structure, or an elongated strap having row of teeth disposed on at least one longitudinal surface of the strap and arranged transversely with respect thereto;

b. the lock including a locking frame for containing the strap, and a pawl for engaging the teeth, ladder, or beaded structure of the pull; and c. the pawl connected to an operable structure, such as a button or lever, operable by a user that acts to release the pawl from engaging the teeth, ladder, or beaded structure of the pull, thereby allowing the follower to travel towards the first open end under the bias of the spring.

15. The ammunition magazine of claim 1 further including:

a. the body of the pull being having a cross section that oscillates in size from a first cross section to a second cross section, the first cross section being smaller than the second;

b. the lock being a throat that has a throat cross section, said throat cross section sized to frictionally engage the body of the pull at the second cross section.

16. The ammunition magazine of claim 1, the follower having the fore tine and the aft tine and further comprising one or more of:

a. at least one lateral surface connecting the fore tine to the aft tine, and/or b. at least one bottom surface connecting the fore tine to the aft tine.

17. A method of loading an ammunition magazine comprises:

a. providing an ammunition magazine, the ammunition magazine comprising:

i. a casing having a mostly rectangular cross-section with fore and aft sides and two longer lateral sides and first and second open ends, ii. a floor plate capable of interfacing the magazine at the second end;

iii. a follower residing within the casing, said follower further comprising:

1. a follower platform extending generally horizontally from a fore end to an aft end, and 2. a fore tine located at the fore end of the follower platform and extending generally perpendicularly from the follower platform fore end to a fore tine end, and/or an aft tine located at the aft end of the follower platform opposing the fore tine and extending generally perpendicularly from the follower platform aft end to an aft tine end, and 3. a pull receiving passage defined by at least one passage wall extending from an underside surface to a head engaging surface;

iv. a follower spring residing between the follower and floor plate; and v. a pull extending through the follower at the pull receiving passage, through a port in the floor plate, the pull defined by a head at a head end connected by a semirigid elongated body to a tail at a tail end, the body adapted and sized to slide within the pull receiving passage of the follower, the head being larger than the pull receiving passage and disposed to engage with head engaging surface of the follower when the pull is pulled towards the floor plate to compress the follower spring b. compressing the follower spring by drawing the pull through the releasable lock, causing the head of the pull to engage the head engaging surface, and causing the follower to travel towards the floor plate;

c. inserting ammunition cartridges into the first open end;

d. after inserting ammunition cartridges into the first end, releasing the pull causing the follower spring to bias the follower towards the first end;

e. after releasing the pull, pushing the pull in a direction towards the first end into the casing;

f. decoupling the head of the pull from the head engaging surface of the follower; and g. sliding the body of the pull through the pull receiving passage of the follower in a direction towards the first open end.

18. A kit for retrofitting an ammunition magazine, the kit comprising a follower, a pull, and a base plate, said follower comprising:

a. follower platform extending generally horizontally from a fore end to an aft end, b. a fore tine located at the fore end of the follower platform and extending generally perpendicularly from the follower platform fore end to a fore tine end, and/or an aft tine located at the aft end of the follower platform opposing the fore tine and extending generally perpendicularly from the follower platform aft end to an aft tine end;

c. a pull receiving passage defined by at least one passage wall extending from an underside surface to a head engaging surface; and d. one or more of the following:

i. the head engaging surface defined as an outside surface of the aft tine or the aft end of the follower platform located at or near to the intersection of the aft end of the follower platform and the aft tine;

ii. the head engaging surface defined as an outside surface of the follower located along the follower platform at a location between the fore end and the aft end;

iii. the head engaging surface defined an exterior surface of the fore tine located at or near to the intersection of the fore end of the follower platform and the fore tine;

iv. the head engaging surface of the follower further being a recess adapted to contain the head of the pull such that the head does not protrude from the follower when a force is exerted on the pull in a direction that compresses the follower spring;

v. the underside surface being an inside surface of the aft tine;

vi. the underside surface being a tip of the aft tine; and/or vii. the passage wall being a groove or channel located on an outside surface of the fore tine;

said pull defined by a head at a head end connected by a semirigid elongated body to a tail at a tail end, the body adapted and sized to slide within the pull receiving passage of the follower, the head being larger than the pull receiving passage and disposed to engage with head engaging surface of the follower when the pull is pulled towards the floor plate to compress the follower spring; and said floor plate capable of interfacing an ammunition magazine at a second end, the floor plate comprising:

a. a port for receiving a pull, and/or b. a releasable lock located at the floor plate and adapted to cooperate with the pull such that, normally, the lock only allows the pull to travel incrementally in a direction that causes the follower to compress the follower spring, but, when a release is engaged, the pull may travel in a direction that allows the follower spring to push the follower away from the floor plate;

wherein said magazine is retrofitted by inserting the pull into the pull receiving passage of the follower such that the head end of the pull engages the head engaging surface, inserting the follower into the magazine, inserting the tail end of the body of the pull into the port and/or releasable lock of the floor plate, and fixing the floor plate onto the second end of the magazine.

* * * * *